US006150622A

United States Patent [19]

Malnati

[11] Patent Number: 6,150,622

[45] Date of Patent: Nov. 21, 2000

[54] ELECTRICAL CONTACT ELEMENT FOR REFRIGERATORS AND SIMILAR

[75] Inventor: Roberto Malnati, Buguggiate, Italy

[73] Assignee: Whirlpool Corporation, Benton Harbor, Mich.

[21] Appl. No.: 09/369,078

[22] Filed: Aug. 5, 1999

[30] Foreign Application Priority Data

Aug. 6, 1998 [IT] Italy ..... MI98A1855

[51] Int. Cl.[7] ..... H01H 3/16

[52] U.S. Cl. ..... 200/61.62; 200/61.76; 200/61.81

[58] Field of Search ..... 200/61.62, 61.63, 200/61.69, 61.71–61.76, 61.78, 61.8, 61.81, 61.82, 61.83, 302.1

[56] References Cited

U.S. PATENT DOCUMENTS

| | | | |
|---|---|---|---|
| 3,573,406 | 4/1971 | Neuhoff | 200/61.41 |
| 3,890,476 | 6/1975 | Canter et al. | 200/61.62 |
| 3,895,198 | 7/1975 | Piber | 200/61.62 X |
| 4,124,791 | 11/1978 | Lewis | 200/534 |
| 4,300,025 | 11/1981 | Prada | 200/61.69 |
| 5,647,117 | 7/1997 | Kurita | 200/302.1 X |
| 5,847,343 | 12/1998 | Kim | 200/61.76 |

*Primary Examiner*—J. R. Scott
*Attorney, Agent, or Firm*—Joel M. Van Winkle; Stephen D. Krefman; Robert O. Rice

[57] ABSTRACT

A door switch assembly for a refrigerator. The door switch assembly includes a housing mounted to one of the walls of the refrigerator and further has an electrical circuit for switching on or off electrical equipment mounted within the refrigerator. The door switch includes a ball retractably mounted in the housing and biased to project partially outward from the at least one wall for engagement with the door. A pusher is slidably mounted adjacent the ball and biased to remain in contact with the ball. A flexible strip contact element is supported within the housing which is moved by the pusher in such a way as to open or close the electrical circuit. The housing includes a projecting portion which extends through an opening provided in the at least one wall, the projection portion includes a deformable flange. A ring engages the projecting portion of the housing for securing the ball within the housing wherein the at least one wall is captured between the ring and the deformable flange such that the housing is secured to the at least one wall.

2 Claims, 2 Drawing Sheets

ELECTRICAL CONTACT ELEMENT FOR REFRIGERATORS AND SIMILAR

BACKGROUND OF THE INVENTION

1.Field of the Invention

The present invention relates to an electrical contact element intended to be applied to refrigerators and similar which are provided with doors whose position of opening and closure determines the state of the said contact element. More particularly, the contact element, which may take the form of an on-off switch or a changeover switch, is capable of assuming different states when the door is closed or open, and this contact element is mainly, but not exclusively, intended for switching a lamp on to illuminate the storage space of the refrigerator when the door is opened. The term refrigerator also includes freezers of the chest and cabinet types.

2. Description of the Related Art

It is known that refrigerators may be required by their purchasers to have doors which open by rotation either in one direction or in an opposite direction. There is also a known way of mounting, on one wall of the storage space of the refrigerator, a unit comprising an electrical contact element, a lamp controlled by this element, and a protective device, generally made from transparent or translucent material, for the lamp. The electrical contact element is operated by the door inner liner (which, as it is known, forms the inner part of the door) in such a way that the lamp is switched on when the door opens, enabling the contents of the storage space to be seen, and is switched off when the door is closed. The main problem which arises is that this unit is mounted on one or other of the vertical walls delimiting the storage space, according to the direction of opening of the door, and frequently, to make this possible, the said units provided for one direction of rotation of the door differ to some extent from those for rotation in the opposite direction.

SUMMARY OF THE INVENTION

One important object of the present invention is therefore to provide a single electrical contact element which is not dependent, as to location, on the direction of rotation of the door. The contact element is designed to permit the positioning of the light source or other controlled equipment in the most convenient place, either inside or outside the refrigerator.

It is known that certain types of refrigerator have fans to circulate the air in the corresponding storage spaces and that the contact element takes the form of a switch which, when the door is closed, enables the fan to be activated and keeps the lamp switched off, whereas when the door is open it switches off the fan and switches on the lamp. This type of switch, as it is known, forms part of the unit indicated above, with the consequences stated previously.

Another object of the present invention is to provide an electrical contact element in the form of a changeover switch, which is independent from the direction of rotation of the door.

Another object of the present invention is to provide an electrical contact element which is automatically sealed in the rear part of the expanded plastic, without additional support or sealing systems.

Another object of the present invention is to provide an electrical contact element which enables the open contact or closed contact functions, or both, to be performed with a small number of parts.

Further objects will be apparent to the person skilled in the art from the following detailed description.

All of these objects are therefore achieved by the electrical contact element according to the disclosures in the attached claims.

BRIEF DESCRIPTION OF THE DRAWINGS

The invention will be more clearly understood from the following detailed description, provided purely by way of example and therefore non-limiting a preferred embodiment of the invention, illustrated in the attached drawings, in which.

DESCRIPTION OF THE PREFERRED EMBODIMENT

Figure 1:
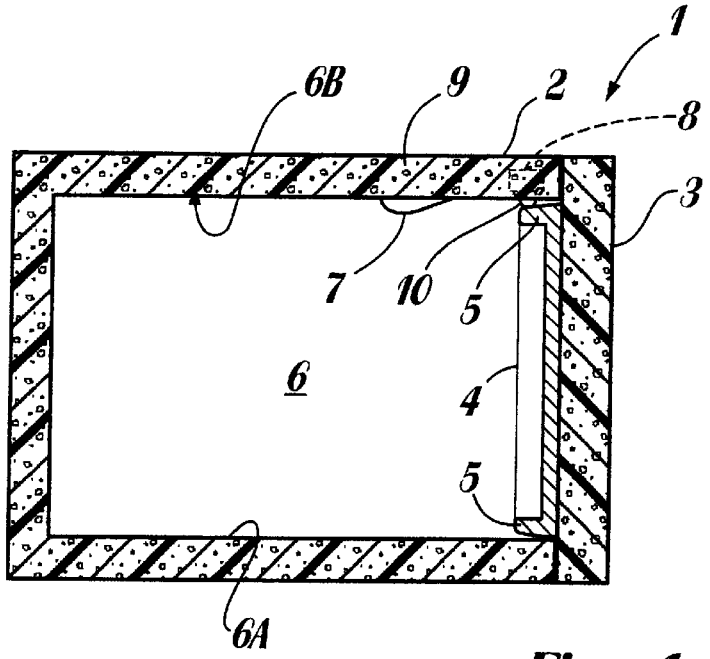
FIG. 1 shows in a highly schematic way a horizontal section through a refrigerator, showing the location of the operating means forming part of the electrical contact element.

With reference to the figures, the number 1 indicates schematically the whole of a refrigerator, shown in horizontal section. It is possible to distinguish the body 2, the door 3 and the door inner liner 4, which is the usual inner component of the door, forming a set of supporting panels and, when the door is closed, having its vertical shoulders 5 extending into the storage space 6. In the storage space, a lamp 7 is mounted on any of the inner walls of the body 2 to illuminate the space 6 when the door 3 is opened.

Figure 2:
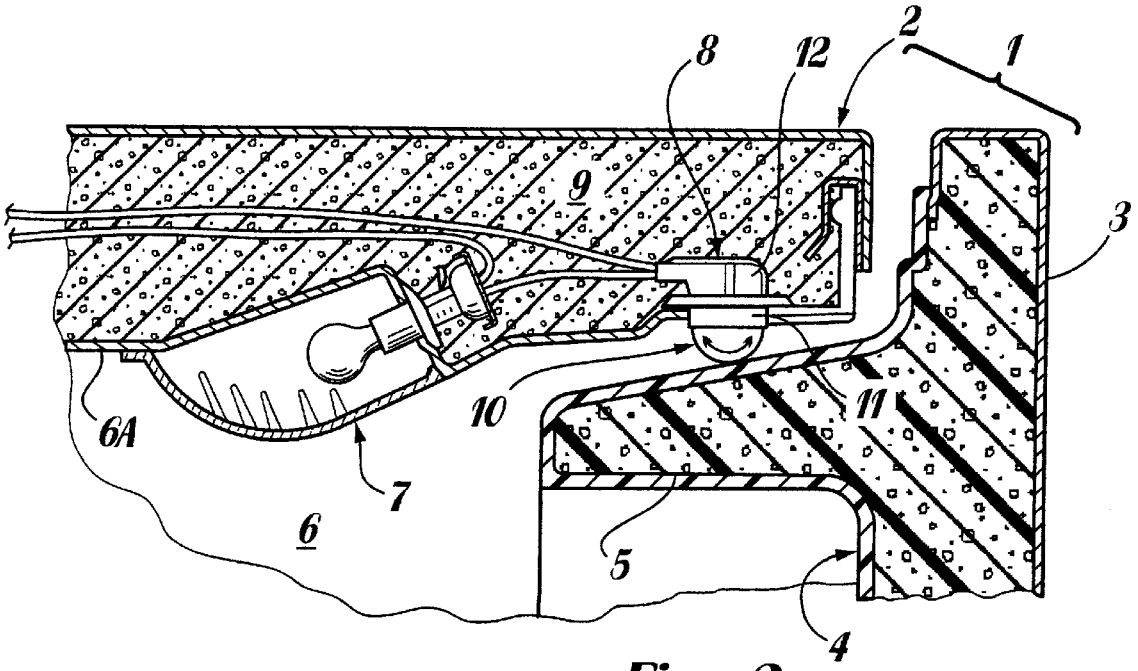
FIG. 2 shows on a larger scale a detail of the horizontal section in FIG. 1.

According to the invention, an electrical contact element 8 for controlling the lamp 7 is located inside the insulation 9 of the body 2, and its operating means 10, projecting into the space near the opening of the space, is designed to be engaged, as shown in FIGS. 1 and 2, when the door is closed, by a shoulder 5 and thus to switch off the lamp 7, which is switched on again when the door is opened, since the shoulder in question is disengaged from the said operating element 10. In this case, the operating element moves in a direction orthogonal to the side walls 6A and 6B of the space 6.

Figure 3:
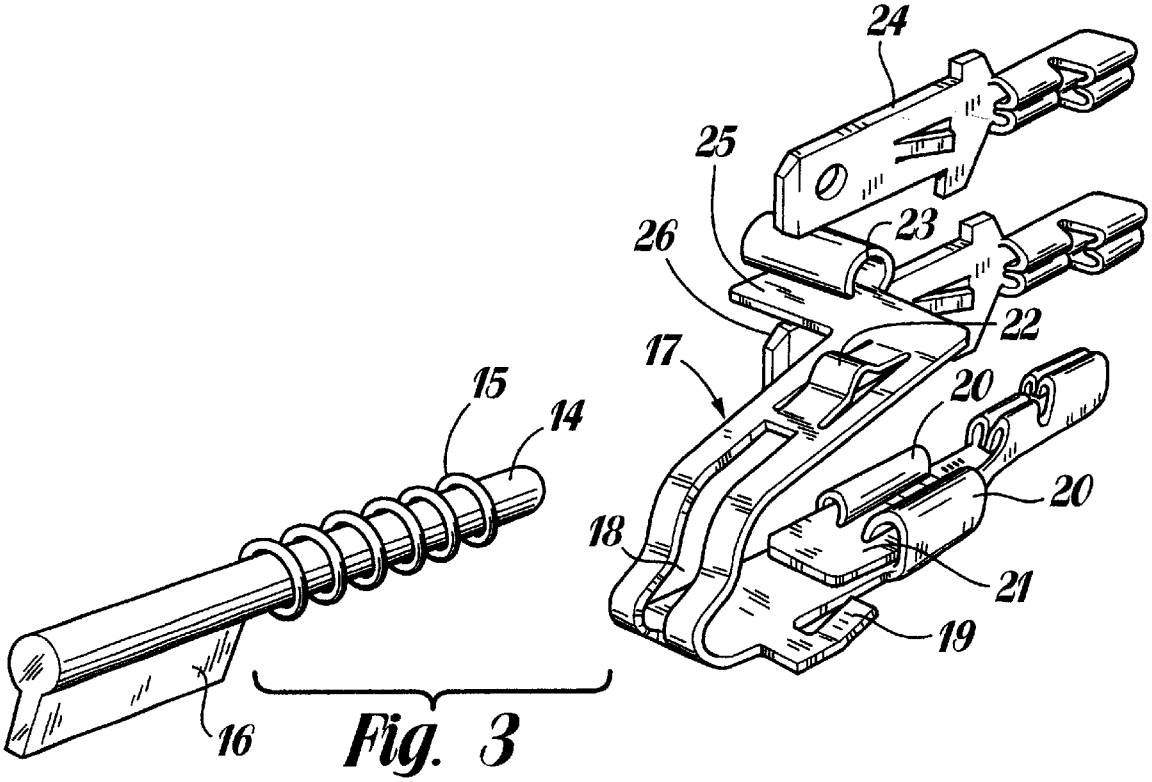
FIG. 3 shows an exploded view of the working parts of the contact element and, partially, of the operating means.
Figure 4:
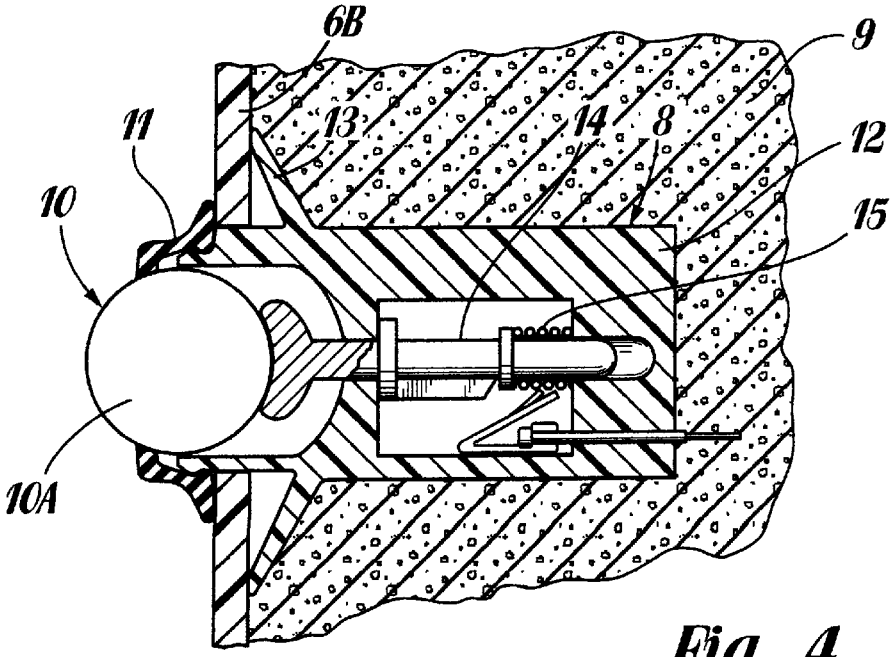
FIG. 4 shows in a schematic and partial vertical section the electrical contact element with the corresponding operating means.

In a preferred embodiment of the invention, the electrical contact element 8 and the corresponding operating means 10 are made as shown in FIGS. 3 and 4. In this example, the operating means, which is an integral part of the electrical element 8, comprises a hollow ball 10A made from insulating material, for example polyethylene, a ring 11, which is connected in any known way, by snap-fitting for example, to the projecting end of a body 12 embedded in the expanded plastic insulation 9 and having a conventional elastically deformable flange 13, whose function is to prevent the leakage of the insulation during its expansion.

A pusher 14 is mounted slidably but not rotatably in the body 12. The pusher is loaded by a compression spring 15 which tends to keep the pusher in contact with the ball. The pusher is movable in a direction orthogonal to the side walls 6A, B of the space 6.

The pusher has a radial rib or projection 16 designed to act, when the door 3 is closed, on an electrical current supply contact 17 which is approximately C-shaped (FIG. 3 in particular) and consists of a flexible strip, centrally lightened by an aperture 18 and provided with teeth 19 for fixing to the body 12. On its lower part, the contact 17 has conventional bent portions 20 forming the socket into which the contact strip (Fast-on) 21 connected to the electrical supply conductor is inserted. On its upper part, the contact 17 has a projecting tongue 22 with which the rib 16 of the pusher can interact as indicated. At its upper end, the flexible contact 17 has a lateral arm 25 provided with a turnover 23 which, when the door is open, makes an electrical contact with a contact strip 24 which is located in the body 12 above the turnover 23 and to which is connected a conductor leading to the lamp 7, which is consequently switched on and which is physically separated from the electrical contact element 8. Under the arm 25 there is another contact strip 26 which, when the door is closed, comes into contact with the arm 25, thus enabling a fan to be switched on, by means of a conductor, to circulate air in the space 6.

When the door 3 is open (FIG. 4) the ball 10A projects, and the projection 16 of the pusher does not act on the contact 17, and consequently the current passes from the element 21 to the element 24 through the flexible contact 17. When the door is closed, the shoulder 5 of the door trim moves the ball 10A and consequently the pusher 14 towards the interior of the body 12, so that the projection 16 of the pusher is engaged with the contact 17, separating the turnover 23 from the strip 24 and breaking the circuit which leads to the lamp 7, but closing, by means of the arm 25 and the strip 26, the circuit leading to the fan.

As shown by the above description, the electrical contact element and the corresponding operating means are not dependent, as to position and mounting, on the direction of rotation of the door of the refrigerator, but can be mounted in the same position in all refrigerators, since one shoulder 5 of the door inner liner 4 will act on the operating means in every case.

The ball 10A can be replaced with a body of a different shape, provided that it is capable of causing the pusher to move inwards when this body interacts with the shoulder of the door inner liner 4.

The example relates to two outputs 24, 26, in other words to a changeover switch, but the invention also includes solutions with a single output (24 or 26) forming an on-off switch.

Similarly, the operating element could be operated in the interior of the refrigerator by an inner box or by a hatch present in the said interior.

What is claimed is:

1. A refrigerator, comprising:

a cabinet having at least one wall;

a door hingedly mounted to the cabinet a door switch assembly having a housing mounted to one of the walls of the refrigerator and further having an electrical circuit for switching on or off electrical equipment mounted within the refrigerator, the door switch including:

a ball retractably mounted in the housing and biased to project partially outward from the at least one wall for engagement with the door, a pusher slidably mounted adjacent the ball and biased to remain in contact with the ball, and a flexible strip contact element supported within the housing which is moved by the pusher in such a way as to open or close the electrical circuit.

2. The refrigerator according to claim 1, wherein the housing includes a projecting portion which extends through an opening provided in the at least one wall, the projection portion includes a deformable flange, and a ring engages the projecting portion of the housing for securing the ball within the housing wherein the at least one wall is captured between the ring and the deformable flange such that the housing is secured to the at least one wall.

* * * * *